US010849391B2

(12) United States Patent
Templeton

(10) Patent No.: US 10,849,391 B2
(45) Date of Patent: Dec. 1, 2020

(54) MULTI-FUNCTION BUCKLE ASSEMBLY

(71) Applicant: Gordon Daniel Oke Templeton, Winnipeg (CA)

(72) Inventor: Gordon Daniel Oke Templeton, Winnipeg (CA)

( * ) Notice: Subject to any disclaimer, the term of this patent is extended or adjusted under 35 U.S.C. 154(b) by 0 days.

(21) Appl. No.: 16/444,045

(22) Filed: Jun. 18, 2019

(65) Prior Publication Data

US 2020/0022463 A1 Jan. 23, 2020

Related U.S. Application Data

(60) Provisional application No. 62/702,043, filed on Jul. 23, 2018.

(51) Int. Cl.
*A44B 11/25* (2006.01)

(52) U.S. Cl.
CPC ..... *A44B 11/2592* (2013.01); *A44B 11/2526* (2013.01)

(58) Field of Classification Search
CPC ..... A44B 11/2592; A44B 11/2526; A44B 11/2561; A44B 11/2519; A44B 11/266
See application file for complete search history.

(56) References Cited

U.S. PATENT DOCUMENTS 2,863,200 A * 12/1958 Miller ..... A44B 11/2519 24/645
3,179,997 A 4/1965 Jalinaud
3,598,443 A * 8/1971 Stoffel ..... A44B 11/2549 297/483
6,301,757 B1 10/2001 Kunii et al.
6,463,640 B1 * 10/2002 Toth ..... A44B 11/266 24/648
6,948,219 B2 * 9/2005 Kakuda ..... B60N 2/2806 24/265 H
8,561,268 B2 10/2013 Hortnagl
8,572,815 B1 * 11/2013 Ivankoe ..... A44B 11/2561 24/165
9,402,447 B2 8/2016 Hortnagl
9,596,908 B2 * 3/2017 Hortnagl ..... A44B 11/10

* cited by examiner

*Primary Examiner* — Robert Sandy
*Assistant Examiner* — Louis A Mercado
(74) *Attorney, Agent, or Firm* — Ryan W. Dupuis; Ade & Company; Kyle R. Satterthwaite

(57) ABSTRACT

A buckle assembly includes a female buckle body that interchangeably mates with either one of a male buckle body or a retainer ring defining a leading bar. The female buckle body has a receptacle to receive an extension portion of the male buckle body slidable therein. A biased lever body is pivotally supported on the female buckle body for cooperating with a catch on the male buckle body between a blocking position retaining the extension portion in the receptacle and a released position allowing removal of the extension portion. The female buckle body also has a slot aligned with the receptacle to receive the leading bar of the retainer ring therein so that the lever body can also selectively retain the retainer ring mated with the female buckle body.

6 Claims, 6 Drawing Sheets

MULTI-FUNCTION BUCKLE ASSEMBLY

This application claims the benefit under 35 U.S.C. 119(e) of U.S. provisional application Ser. No. 62/702,043, filed Jul. 23, 2018.

FIELD OF THE INVENTION

The present invention relates to a buckle assembly including a male buckle body defining an extension with catches and a female buckle body defining a receptacle with locking elements carried on levers which selectively retain the extension of the male buckle body within the receptacle, and more particularly the present invention relates to a female buckle assembly which can interchangeably retain either one of the extension of the male buckle body or a portion of a retainer ring therein.

BACKGROUND

It is known in various industries to couple two objects together using a buckle assembly in which a male buckle component is inserted into a female buckle component in which a releasable latch selectively retains the male buckled component within the female buckle component.

U.S. Pat. Nos. 8,561,268 and 9,402,447, both by Hortnagl, disclose examples of a buckle assembly in which the male buckle element defines catches which are selectively engaged by levers on the female buckle element to retain the assembly in a coupled configuration. The female buckle assembly only functions when used with the corresponding male buckle element configured to be received therein.

U.S. Pat. No. 6,301,757 by Kunii and U.S. Pat. No. 3,179,997 by Jalinaud disclose examples of buckle assemblies in which a post on the male buckle element is selectively retained within a slot on the female buckle element by one or more hooks pivotally supported on the female buckle element. Again, the buckle assembly only functions when used with the corresponding male buckle element configured to be received therein.

SUMMARY OF THE INVENTION

According to one aspect of the invention there is provided a buckle assembly for use with a retainer ring defining a leading bar, the buckle assembly comprising:

a male buckle body including a base portion, an elongate extension portion extending in a longitudinal direction from the base portion towards a free end of the male buckle body, and at least one catch formed on the extension portion which is oriented transversely to the longitudinal direction of the male buckle body;

a female buckle body defining a receptacle therein extending inwardly into the female buckle body from an open end of the receptacle in a longitudinal direction of the female buckle body such that the receptacle is adapted to receive the extension portion of the male buckle body longitudinally slidable therein through the open end of the receptacle;

a lever body pivotally supported on the female buckle body in association with said at least one catch, the lever body defining a locking element therein which is pivotal with the lever body relative to the female buckle body between (i) a blocking position in which the locking element is in interference with the catch so as to prevent removal of the extension portion from the receptacle and (ii) a released position in which the catch is unobstructed by the locking element such that the extension portion is slidably removable from the receptacle, the locking element being pivotal from the blocking position towards the released position in a direction which is opposite to forces acting on the locking element by the catch when urging removal from extension portion from the receptacle;

a slot formed in the female buckle body in alignment with the receptacle to extend longitudinally inwardly from the open end of the receptacle, the slot having a width between opposite edges which is adapted to receive the leading bar of the retainer ring longitudinally slidable therein when the male buckle body is separated from the female buckle body;

the lever body associated with said at least one catch further comprising a locking extension protruding from the lever body at least partway across the slot in the blocking position so as to prevent removal of the leading bar of the retainer ring from the slot, the locking extension being movable with the lever body from the blocking position to the released position in which the slot is unobstructed by the locking extension to allow removal of the leading bar of the retainer ring from the slot;

whereby the female buckle body is adapted to interchangeably receive and selectively retain the male buckle body and the retainer ring therein.

The configuration of the female buckle body having a receptacle for extension of the male buckle part and a slot for the retainer ring, together with a lever body having both a locking element to engage the male buckle body and a locking extension to engage the retainer ring, a single female buckle body has a dual function of cooperating with either a male buckle body or a retainer ring using a simple mechanism.

Preferably said at least one catch does not interfere with insertion of the retainer ring into or removal of the retainer ring from the slot throughout a range of motion of the lever body between the blocking position and the released position thereof.

Preferably the locking extension is spaced in an axial direction of pivotal movement of the lever body relative to the female buckle body from the extension portion and said at least one catch supported thereon when the male buckle body is received in the female buckle body.

When the extension portion of the male buckle body supports two catches thereon, preferably two lever bodies are pivotally supported on female buckle body having locking elements which are movable between respective blocking and released positions relative to the two catches respectively, in which each lever body supports a locking extension thereon such that the locking extensions protrude at least partway across the slot from the opposite edges of the slot respectively.

According to another aspect of the present invention there is provided a buckle assembly comprising:

a retainer ring defining a leading bar;

a female buckle body defining a slot therein which extends longitudinally inwardly from an open end of the body, the slot having a width between opposite edges which is adapted to receive the leading bar of the retainer ring longitudinally slidable therein;

two lever bodies pivotally supported on the female buckle body in proximity to the opposite edges at opposing sides of the slot, each lever body defining a locking extension thereon which is pivotal with the lever body relative to the female buckle body between (i) a blocking position in which the locking extension protrudes at least partway across the slot such that the two locking extensions collectively prevent removal of the leading bar of the retainer ring from the slot and (ii) a released position in which the slot is unobstructed by the locking extensions such that the leading bar of the retainer ring is slidably removable from the slot, the locking extensions being pivotal from the blocking position towards the released position in a direction which is opposite to forces acting on the locking extension by leading bar of the retainer ring when urging removal from retainer ring from the receptacle.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
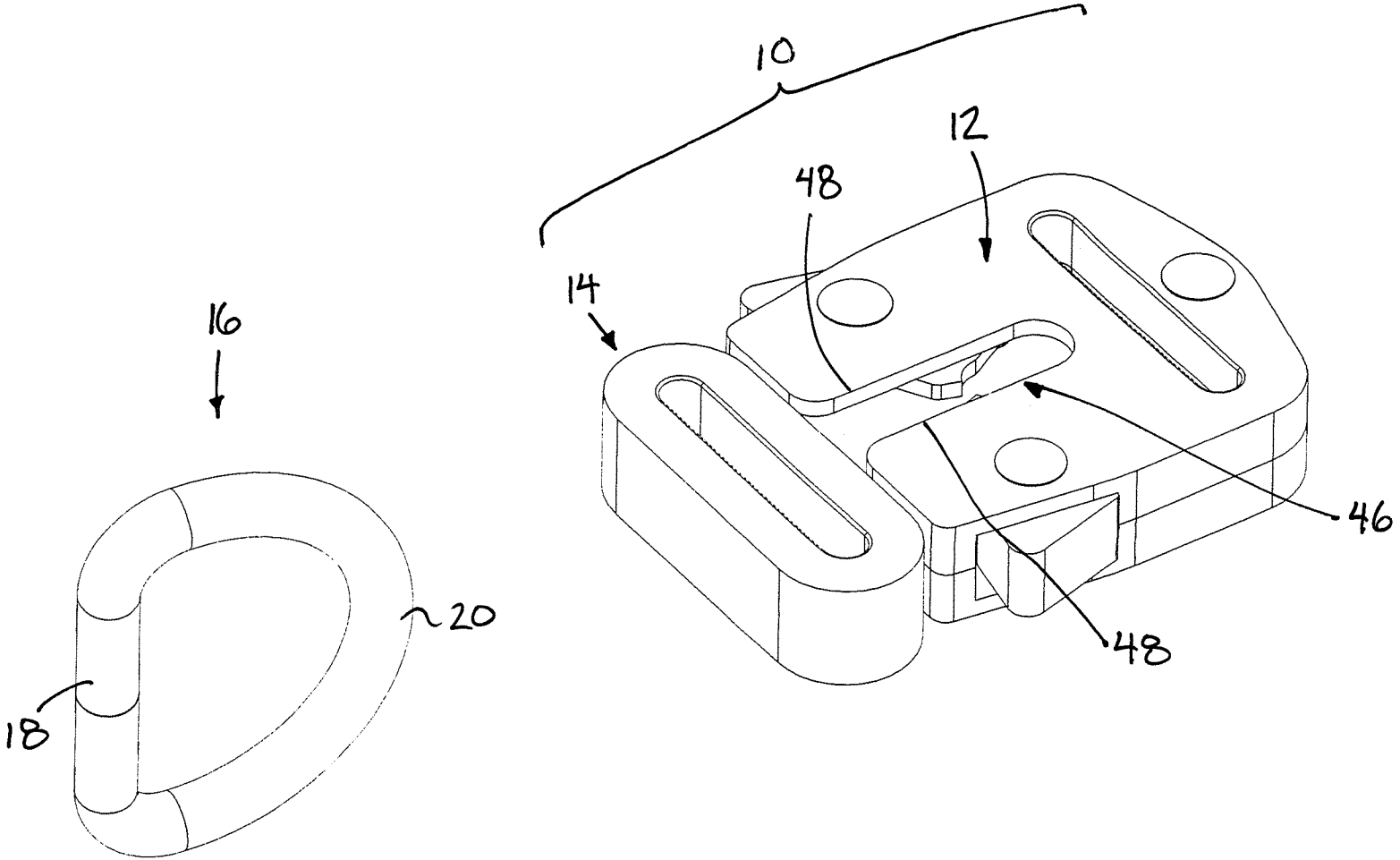
FIG. 1 is perspective view of the buckle assembly showing the male buckle component received within the female buckle component.
Figure 2:
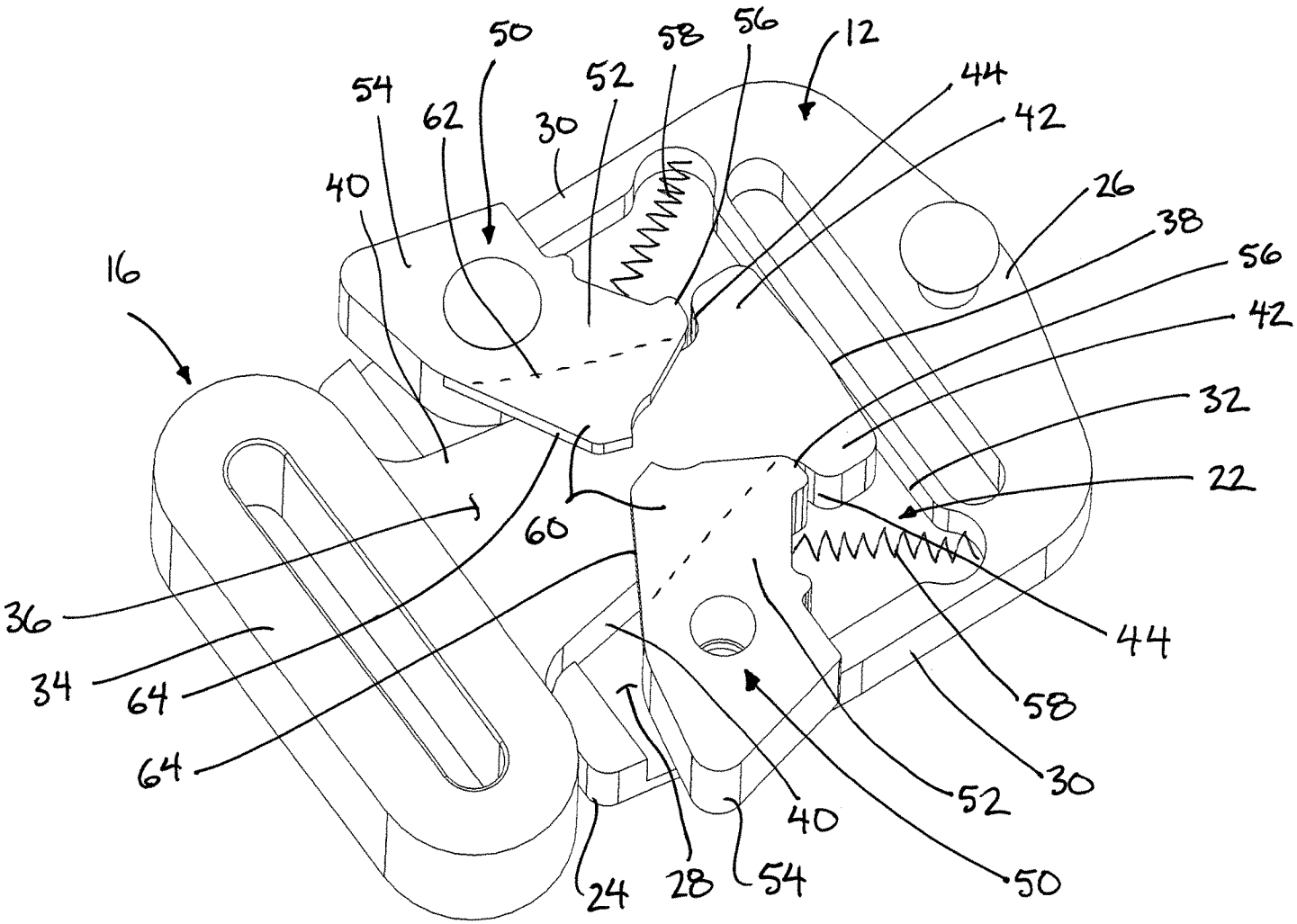
FIG. 2 is a perspective view of the buckle assembly according to FIG. 1 with a portion of the female buckle component shown removed for illustrative purposes.
Figure 3:
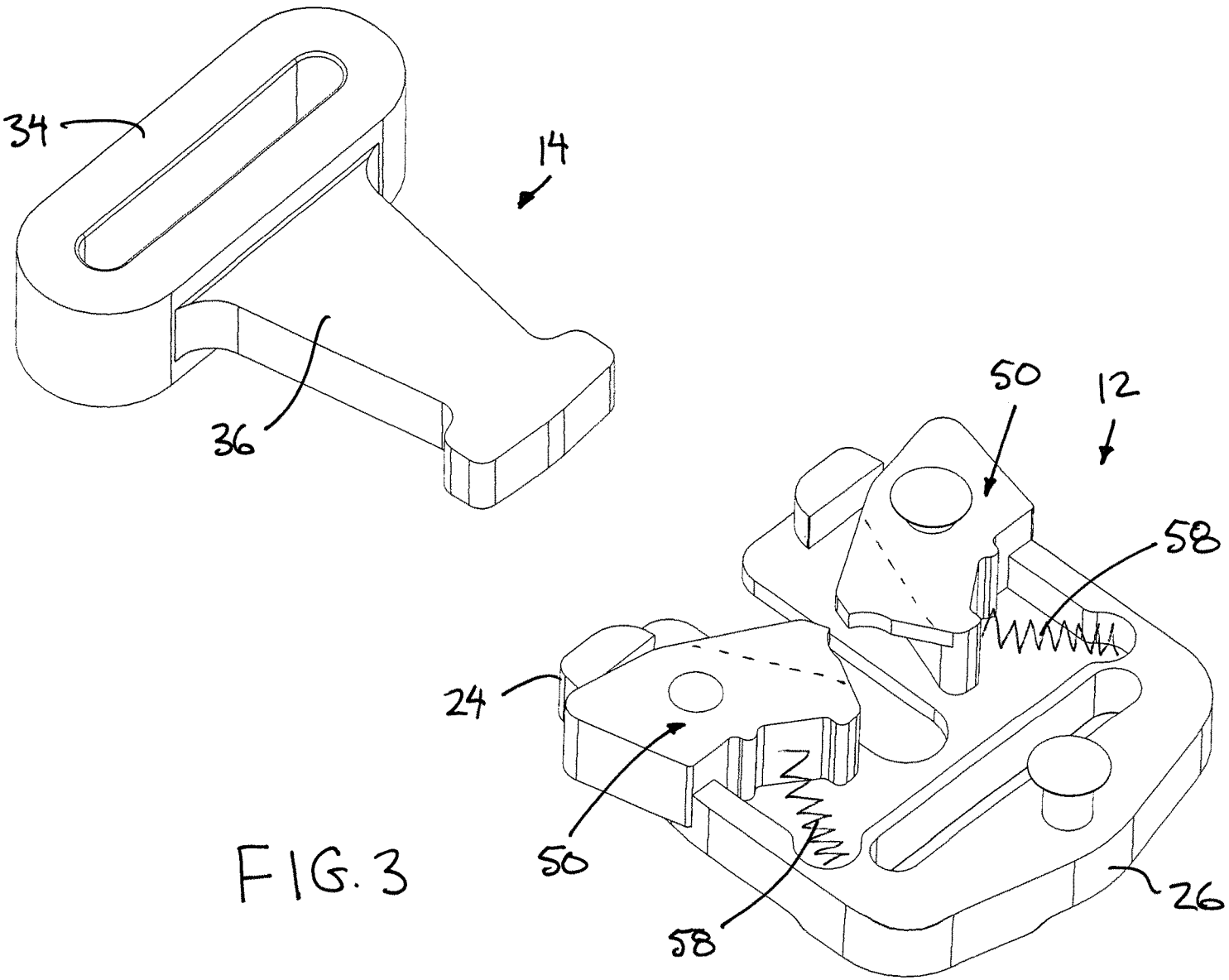
FIG. 3 is another perspective view of the buckle assembly of FIG. 1 with a portion of the female buckle component shown removed for illustrative purposes.
Figure 4:
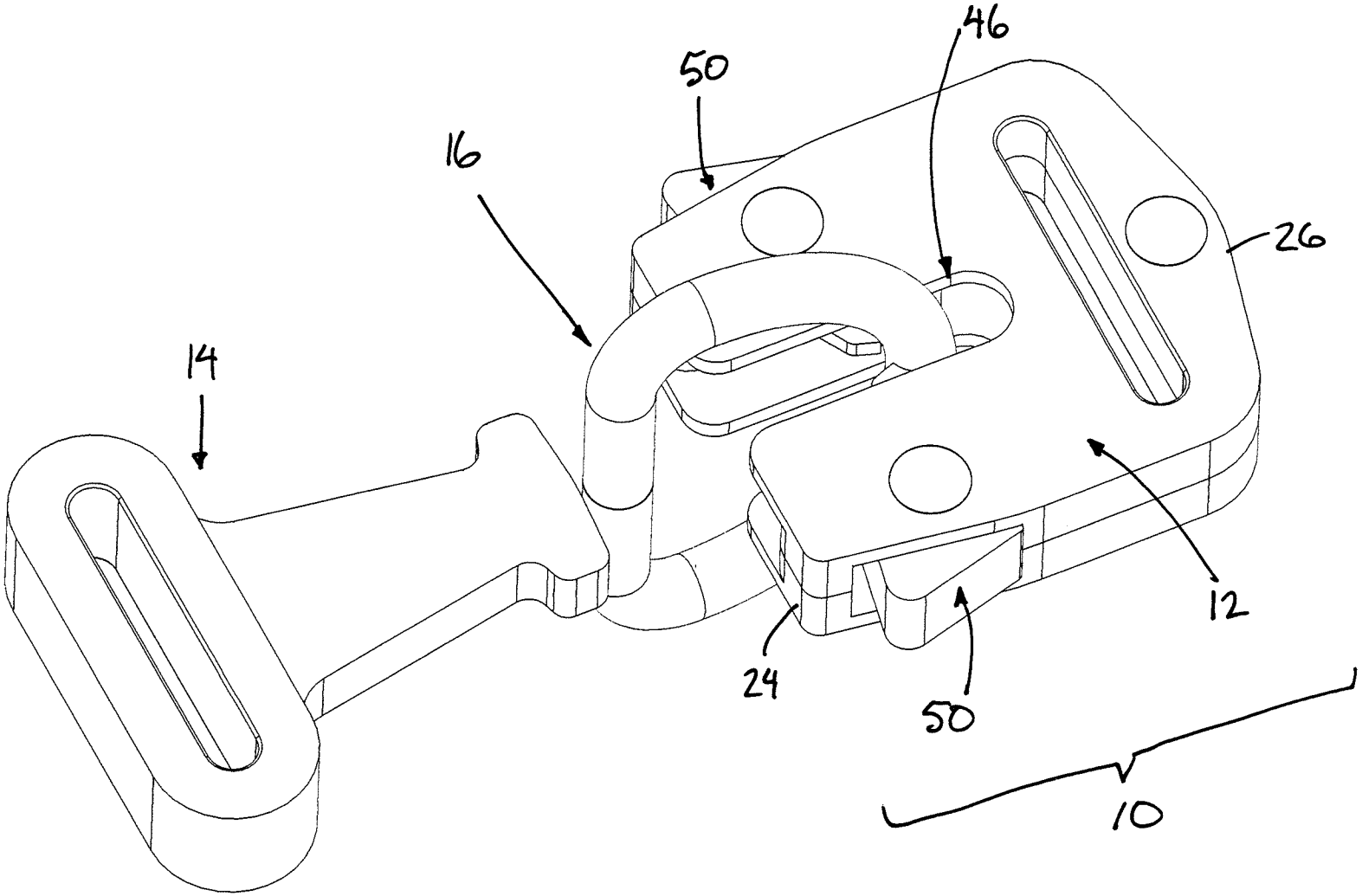
FIG. 4 is a perspective view of the buckle assembly of FIG. 1 in which the retainer ring is received within the female buckle component in place of the male buckle component.
Figure 5:
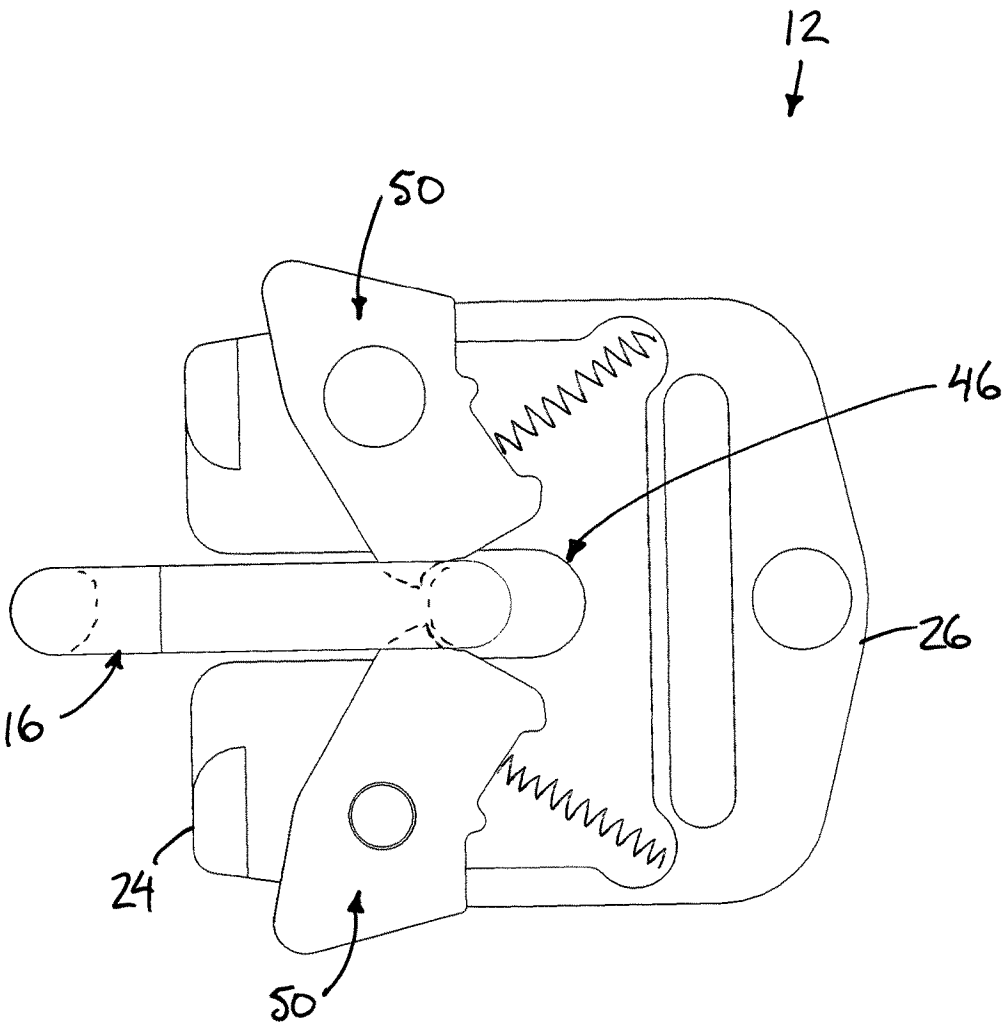
FIG. 5 is a plan view of the buckle assembly according to FIG. 4 in which a portion of the female buckle component has been removed for illustrative purposes.
Figure 6:
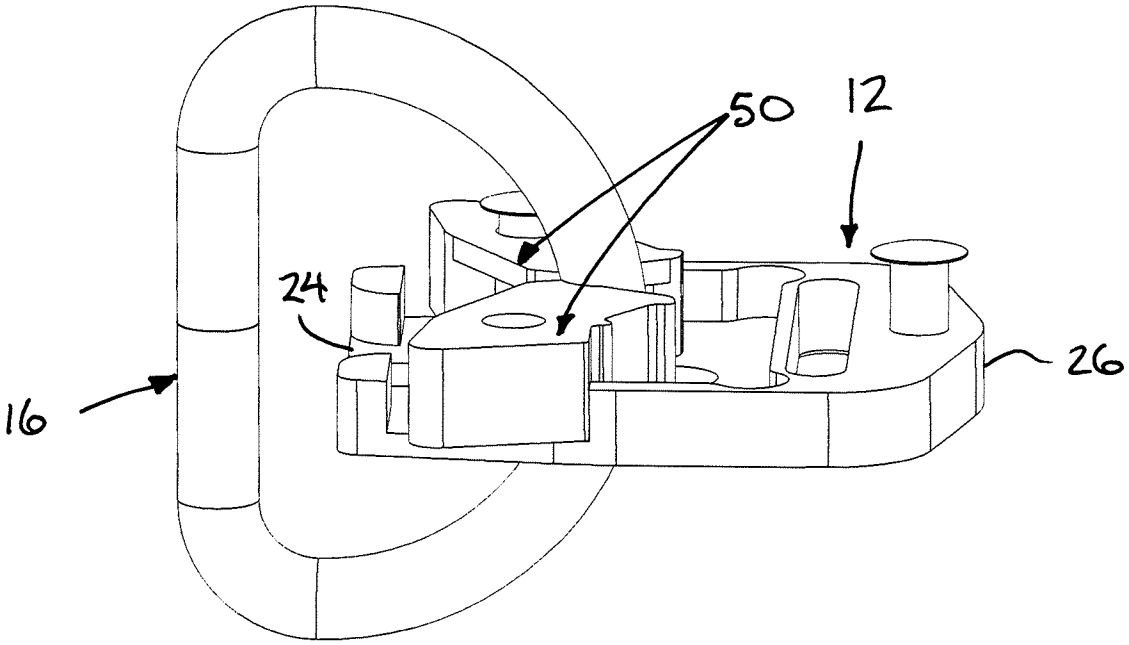
FIG. 6 is another perspective view of the buckle assembly according to FIG. 4 with a portion of the female buckle component shown removed for illustrative purposes.

Referring to the accompanying figures there is illustrated a buckle assembly generally indicated by reference numeral 10. The buckle assembly 10 includes a female buckle component 12 that interchangeably receives either one of a male buckle component 14 or a ring component 16 to selectively retain the component until released by the operator.

The ring component 16 is a rigid ring which is generally D-shaped so as to define a flat trailing bar 18 for anchoring within a loop of strapping for example, and an arcuate leading bar 20 which is generally semicircular in shape and joined at opposing ends to the opposing ends of the trailing bar 18.

The female component comprises a female buckle body defining an internal receptacle 22 therein which extends longitudinally inward from an open end 24 of the body to an opposing base portion 26 forming an internal closed end of the receptacle. The female buckle body is primarily defined by two side plates 28 which are mounted parallel and spaced apart from one another to define the receptacle 22 therebetween. The two side plates 28 are joined by side walls 30 along most of the length of the longitudinally extending side edges thereof, and by a rear wall 32 connected between the side plates at the base portion 26 opposite the open end 24. The internal cavity between the side plate 28 which defines the receptacle remains open to the exterior of the female buckle body at the open end 24.

The female buckle body further defines a rigid loop formed at the base portion 26 rearward of the rear wall 32 to define a slotted opening suitable for receiving the loop of a strap therein for example.

The male buckle component 14 includes a male buckle body also having a base portion 34 forming a rigid loop to define a slotted opening suitable for receiving the loop of a strap therein for example. The male buckle component also includes an extension portion 36 extending in a longitudinal direction from the base portion 34 towards an opposing free end 38 thereof at the opposing end of the male buckle body. The extension portion is reduced in lateral width and thickness relative to the base portion 34, having suitable dimensions for being longitudinally slidable into the receptacle 22 of the female buckle body through the open end 24 thereof. The enlarged dimensions of the base portion 34 relative to the extension portion 36 of the male buckle body prevents the base portion from being received in the receptacle such that the base portion 34 of the male buckle body abuts the end face of the female buckle body about the receptacle at the open end 24 thereof in a coupled position of the male buckle body received within the female buckle body.

The extension portion 36 is formed of rigid plate material having opposing flat surfaces defining a thickness of the extension portion therebetween. The flat surfaces extend longitudinally between the base portion and the free end 38 of the male buckle body while spanning laterally between opposing side edges 40 which define the overall width of the extension portion therebetween. The opposing side edges 40 of the extension portion 36 extend longitudinally from the base portion towards the free end in a tapered relationship so that the overall width becomes narrower towards the free end.

A pair of laterally protruding lobes 42 protrude laterally outwardly from the two side edges 40 at the free end 38 to increase the overall width at the free end. The two lobes define catches 44 thereon as the surfaces on the lobes which face towards the base portion 34 at the opposing end of the male buckle body. The surfaces of the catches 44 are thus oriented transversely to the longitudinal direction and serve to selectively retain the male buckle body in the coupled position within the female buckle body as described in further detail below.

The female buckle body further comprises a retainer slot 46 formed therein to extend longitudinally inward into the female buckle body from the open end 24 thereof so as to be at laterally centred relative to the receptacle with which the slot is aligned. The slot extends fully through the body so as to include a portion of the slot formed within each of the opposing side plates 28 of the female buckle body. The slot is elongate in the longitudinal direction having an overall width in the lateral direction defined between two opposing side edges 48 of the slot in which the side edges are parallel to one another at a spacing which is slightly greater than the diameter of the leading bar 20 of the ring component 16. In this manner, the leading bar of the ring component can be received longitudinally slidable into the female buckle body within the slot 46 such that the bar 20 protrudes outwardly through both opposing side plates 28 in a coupled position of the retainer ring relative to the female buckle component.

The buckle assembly further includes two lever bodies 50 which are pivotally supported on the female buckle body within the internal cavity between the two side plates 28 of the body. The lever bodies are positioned at laterally opposing sides of the receptacle which further corresponds to laterally opposing sides of the slot 46 due to the alignment of the slot with the receptacle. Each lever body is pivotal about a respective lever axis which is oriented perpendicularly to the side plates 28 of the female buckle body between a blocking position and a released position as described in further detail below.

In the blocking position, each lever body includes an inner portion 52 extending generally inwardly towards the opposing lever body from the respective lever axis and an outer portion 54 extending generally laterally outwardly away from the opposing lever body so as to protrude outwardly through a respective opening formed in the side wall 30 of the female buckle body. The inner portion 52 of each lever body defines a locking element 56 thereon corresponding to a surface adjacent the inner end of the lever body which is adapted for alignment with and in positive engagement with a respective one of the catches 44 on the male buckle body when the male buckle body is coupled to the female buckle body.

The locking element on the inner portion of the lever body is received between the catch and the open end of the female buckle body such that any longitudinal displacement of the male buckle body outward from the female buckle body causes the catches to engage upon the locking elements 56 in the blocking position of the lever bodies. The lever bodies are pivotal from the blocking position to the released position by an operator pressing laterally inwardly on the protruding outer portions 54 of the lever bodies to cause the lever bodies to be pivoted about the respective lever axes thereof, thus displacing the inner portions 52 of the lever bodies away from the open end of the female buckle body and laterally outwardly towards the side walls 30 until the catches 44 are no longer in interference with the locking elements on the lever bodies and slidable removal of the male buckle body from the female buckle body is unobstructed by the locking element on the lever bodies. When in the blocking position, further pivotal movement of the lever bodies beyond the blocking position towards the open end of the female buckle body in the direction of removal of the male buckle body is blocked by engagement of the outer portions 54 of the lever bodies with the edges of the side wall 30 of the female buckle body which function as stops thereby retaining the male buckle component in the coupled position.

A suitable spring 58 is received within the cavity of the female buckle body in association with each lever body 50 by being mounted in compression between the respective side wall 30 and the inner portion 52 of the lever body so that the spring is compressed as the lever body is displaced from the blocking position to the released position. In this manner the lever bodies are biased towards the blocking position.

Each lever body 50 further includes a locking extension 60 protruding inwardly from the inner portion of the lever body beyond the locking element 56 in the blocking position. More particularly, the locking extensions 60 each extend laterally inwardly towards one another partway across the width of the slot 46 to respective apexes of the locking extensions which are in close proximity to one another in the blocking position. The remaining lateral gap between the locking extensions in the blocking position is less than the cross sectional diameter of the leading bar 20 of the retainer ring 16 so as to prevent removal of the ring 16 from the slot 46 when the locking extensions 60 are in the blocking position.

When the retainer ring is received within the slot 46 in the female buckle body so as to be abutted with the inner, terminal end of the slot, the leading bar 20 of the retainer ring is positioned between the locking extensions 60 in the blocking position and the terminal end of the slot so as to be retained within the slot. Attempting to remove the retainer ring from the slot by displacing the retainer ring longitudinally outward causes the leading bar to engage concave inner surfaces of the locking extensions 60 to urge the locking extensions towards the open end of the female buckle body. Further pivotal movement of the lever bodies beyond the blocking position in that direction however is blocked by engagement of the outer portions 54 of the lever bodies with the edges of the side wall 30 of the female buckle body which function as stops similarly to the lever bodies retaining the male buckle component in the coupled position.

The retainer ring is released similarly to releasing of the male buckle component by the operator pressing the outer portions 54 of the lever bodies laterally inwardly towards one another and towards the open end of the female buckle body to cause the locking extensions 60 to be pivoted together with the respective locking elements of the lever bodies from the blocking positions to the released positions thereof. In the released position, the locking extensions are displaced laterally outwardly and towards the base portion of the female buckle body until they no longer protrude inwardly beyond the opposing side edges of the slot 46 such that the slot is unobstructed by the locking extensions 60 and there is no interference by the locking extensions to the longitudinal sliding removal of the leading bar 20 of the retainer ring from the slot 46 in the female buckle body.

The locking extensions 60 are flat planar members which are offset in the axial direction of the lever axes relative to the locking element 56 on the lever bodies and relative to the extension portion of the male buckle body when the extension portion of the male buckle body is received within the receptacle of the female buckle body. In this instance, the locking extensions 60 do not obstruct or interfere with movement of the male buckle body into or out of the receptacle in the female buckle body.

Similarly, the locking elements 56 which engage the catches on the male buckle body are recessed laterally outwardly and away from one another relative to the locking extensions 60 sufficiently that the locking elements 56 do not protrude into or otherwise obstruct the slot 46 throughout the entire range of movement of the lever bodies between the blocking positions and the released positions thereof.

The inner portion of each lever body 50 is further provided with a ramped surface 62 facing longitudinally outward toward the open end of the female buckle body in the blocking position so as to be longitudinally opposite from the locking elements 56 then engage the catches of the male buckle body. In this manner, when initially inserting the male buckle body into the female buckle body with the lever bodies biased into the blocking positions thereof, the lobes defining the catches 44 thereon engage the ramped surfaces 62 of the lever bodies so that continued insertion of the male buckle body into the receptacle of the female buckle body causes the lever bodies to be pivoted towards the released position thereof sufficiently to allow the lobes 42 to be displaced longitudinally inward beyond the locking element 56 so that the springs 68 bias the lever body to return to the blocking position once the male buckle body has been fully inserted into the female buckle body. Due to the offset of the locking extensions 60 in the axial direction of the lever axes relative to the male buckle body, the locking extensions do not interfere with pivoting of the lever bodies between the blocking and released positions thereof during insertion of the male buckle body into the female buckle body. The lever bodies retain the male buckle body within the receptacle until the operator engages the outer portions 54 of the lever bodies to manually displace them against the spring biased towards the released position.

Each locking extension 60 also includes a ramped surface 64 thereon longitudinally opposite from the concave surface that engages the leading bar of the retainer ring when retaining the retainer ring coupled with the female buckle body. The ramped surfaces 64 of the locking extensions thus similarly face outwardly towards the open end of the female buckle body in the blocking position. In this manner, insertion of the leading bar of the retainer ring into the slot 46 causes the leading bar to engage the ramped surfaces 64 and automatically deflect the lever bodies against the bias of the springs 58 from the blocking position towards the released position until the locking extensions are laterally spaced apart from one another by the diameter of the leading bar to allow the leading bar to be fully inserted up to the terminal end of the slot 46. Once the leading bar has been displaced longitudinally beyond the locking extensions 60, the locking extensions pivot with the lever bodies back to the blocking positions thereof under action of the springs 58 which then retain the retainer ring within the female buckle body in a coupled position thereof.

In this manner, the female buckle body as described herein is provided with the dual function of accepting either one of a male buckle body or a retainer ring interchangeably therein, with the lever bodies being suitably equipped to selectively retain either one of the male buckle body or the retainer ring within the female buckle body in the blocking position thereof.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A buckle assembly for use with a retainer ring defining a leading bar, the buckle assembly comprising:

a male buckle body including a base portion, an elongate extension portion extending in a longitudinal direction from the base portion towards a free end of the male buckle body, and at least one catch formed on the extension portion which is oriented transversely to the longitudinal direction of the male buckle body;

a female buckle body defining a receptacle therein extending inwardly into the female buckle body from an open end of the receptacle in a longitudinal direction of the female buckle body such that the receptacle is adapted to receive the extension portion of the male buckle body longitudinally slidable therein through the open end of the receptacle;

a lever body pivotally supported on the female buckle body in association with said at least one catch, the lever body defining a locking element therein which is pivotal with the lever body relative to the female buckle body between (i) a blocking position in which the locking element is in interference with the catch so as to prevent removal of the extension portion from the receptacle and (ii) a released position in which the catch is unobstructed by the locking element such that the extension portion is slidably removable from the receptacle, the locking element being pivotal from the blocking position towards the released position in a direction which is opposite to forces acting on the locking element by the catch when urging removal from extension portion from the receptacle;

a slot formed in the female buckle body in alignment with the receptacle to extend longitudinally inwardly from the open end of the receptacle, the slot having a width between opposite edges which is adapted to receive the leading bar of the retainer ring longitudinally slidable therein when the male buckle body is separated from the female buckle body;

the lever body associated with said at least one catch further comprising a locking extension protruding from the lever body at least partway across the slot in the blocking position such that the locking extension prevents removal of the leading bar of the retainer ring from the slot, the locking extension being movable with the lever body from the blocking position to the released position in which the slot is unobstructed by the locking extension to allow removal of the leading bar of the retainer ring from the slot;

whereby the female buckle body is adapted to interchangeably receive and selectively retain the male buckle body and the retainer ring therein; and wherein the locking extension on the lever body associated with said at least one catch that engages the leading bar when the retainer ring is received in the female buckle body in the blocking position is independent and separate from the locking element on the lever body associated with said at least one catch that engages the catch when the male buckle body is received in the female buckle body in the blocking position.

2. The buckle assembly according to claim 1 wherein the locking element associated with said at least one catch does not interfere with insertion of the retainer ring into or removal of the retainer ring from the slot throughout a range of motion of the lever body between the blocking position and the released position thereof.

3. The buckle assembly according to claim 1 wherein the lever body is pivotal about a respective lever axis relative to the female buckle body and wherein the locking extension is spaced in an axial direction of said lever axis from the extension portion and said at least one catch supported thereon when the male buckle body is received in the female buckle body.

4. The buckle assembly according to claim 1 wherein the extension portion of the male buckle body supports two catches thereon and wherein two lever bodies are pivotally supported on the female buckle body having locking elements which are movable between respective blocking and released positions relative to the two catches respectively, and wherein each lever body supports a locking extension thereon such that the locking extensions protrude at least partway across the slot from the opposite edges of the slot respectively.

5. A buckle assembly comprising:

a retainer ring defining a leading bar;

a female buckle body defining a slot therein which extends longitudinally inwardly from an open end of the body, the slot having a width between opposite edges which is adapted to receive the leading bar of the retainer ring longitudinally slidable therein;

two lever bodies pivotally supported on the female buckle body in proximity to the opposite edges at opposing sides of the slot, each lever body defining a locking extension thereon which is pivotal with the lever body relative to the female buckle body between (i) a blocking position in which the locking extension protrudes at least partway across the slot such that the two locking extensions collectively prevent removal of the leading bar of the retainer ring from the slot and (ii) a released position in which the slot is unobstructed by the locking extensions such that the leading bar of the retainer ring is slidably removable from the slot, the locking extensions being pivotal from the blocking position towards the released position in a direction which is opposite to forces acting on the locking extension by the leading bar of the retainer ring when urging removal of the retainer ring from the slot.

6. A buckle assembly for use with a retainer ring defining a leading bar, the buckle assembly comprising:

a male buckle body including a base portion, an elongate extension portion extending in a longitudinal direction from the base portion towards a free end of the male buckle body, and at least one catch formed on the extension portion which is oriented transversely to the longitudinal direction of the male buckle body;

a female buckle body defining a receptacle therein extending inwardly into the female buckle body from an open end of the receptacle in a longitudinal direction of the female buckle body such that the receptacle is adapted to receive the extension portion of the male buckle body longitudinally slidable therein through the open end of the receptacle;

a lever body pivotally supported on the female buckle body in association with said at least one catch, the lever body defining a locking element therein which is pivotal with the lever body relative to the female buckle body between (i) a blocking position in which the locking element is in interference with the catch so as to prevent removal of the extension portion from the receptacle and (ii) a released position in which the catch is unobstructed by the locking element such that the extension portion is slidably removable from the receptacle, the locking element being pivotal from the blocking position towards the released position in a direction which is opposite to forces acting on the locking element by the catch when urging removal from extension portion from the receptacle;

a slot formed in the female buckle body in alignment with the receptacle to extend longitudinally inwardly from the open end of the receptacle, the slot having a width between opposite edges which is adapted to receive the leading bar of the retainer ring longitudinally slidable therein when the male buckle body is separated from the female buckle body;

the lever body associated with said at least one catch further comprising a locking extension protruding from the lever body at least partway across the slot in the blocking position so as to prevent removal of the leading bar of the retainer ring from the slot, the locking extension being movable with the lever body from the blocking position to the released position in which the slot is unobstructed by the locking extension to allow removal of the leading bar of the retainer ring from the slot;

whereby the female buckle body is adapted to interchangeably receive and selectively retain the male buckle body and the retainer ring therein;

wherein the extension portion of the male buckle body supports two catches thereon;

wherein two lever bodies are pivotally supported on the female buckle body having locking elements which are movable between respective blocking and released positions relative to the two catches respectively; and wherein each lever body supports a locking extension thereon such that the locking extensions protrude at least partway across the slot from the opposite edges of the slot respectively.

* * * * *